United States Patent [19]

Leuschner

[11] 4,065,916

[45] Jan. 3, 1978

[54] ELECTRONIC TIMEPIECE

[75] Inventor: Horst Leuschner, Garland, Tex.

[73] Assignee: Texas Instruments Incorporated, Dallas, Tex.

[21] Appl. No.: 759,696

[22] Filed: Jan. 17, 1977

[51] Int. Cl.[2] ..... G04C 3/00; G04B 19/00

[52] U.S. Cl. ..... 58/23 BA; 58/23 R; 58/23 AC; 58/50 R

[58] Field of Search ..... 58/4 A, 23 R, 23 AC, 58/23 BA, 23 C, 50 R

[56] References Cited

U.S. PATENT DOCUMENTS

| | | | |
|---|---|---|---|
| 3,576,099 | 4/1971 | Walton | 58/23 R |
| 3,643,418 | 2/1972 | Polin et al. | 58/23 R |
| 3,962,858 | 6/1976 | Levine et al. | 58/4 A |
| 3,975,896 | 8/1976 | Kasama | 58/50 R |

*Primary Examiner*—E. S. Jackmon

*Attorney, Agent, or Firm*—René E. Grossman; Stephen S. Sadacca

[57] ABSTRACT

An electronic timepiece includes a shutdown latch circuit. The latch circuit is initially set by insertion of a battery power source in the electronic timepiece. When the latch circuit is set, all other circuits in the timepiece, and particularly the display circuits, are turned off to conserve battery power during the "shelf-life" of the electronic timepiece. When the command switch is first activated, the latch circuit is reset, and all of the other electronic circuits are turned on in a predetermined initialized condition.

24 Claims, 4 Drawing Figures

Fig. 1
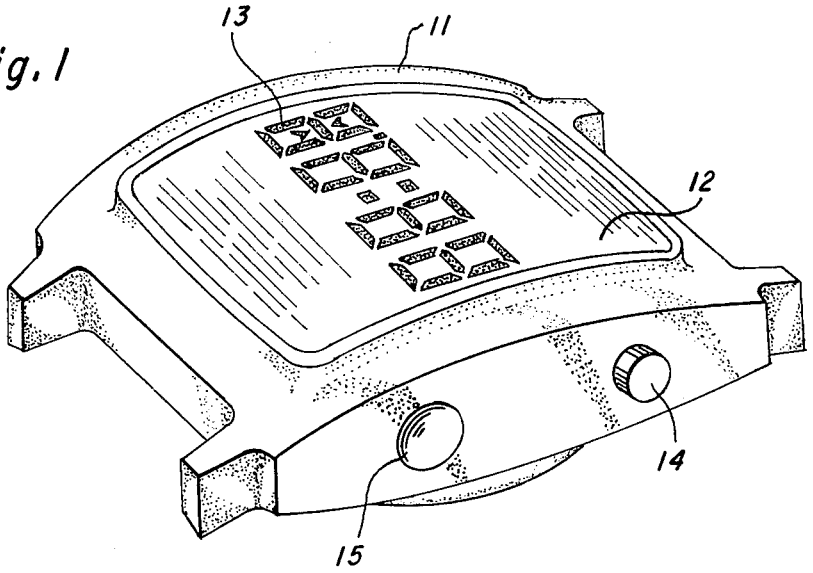
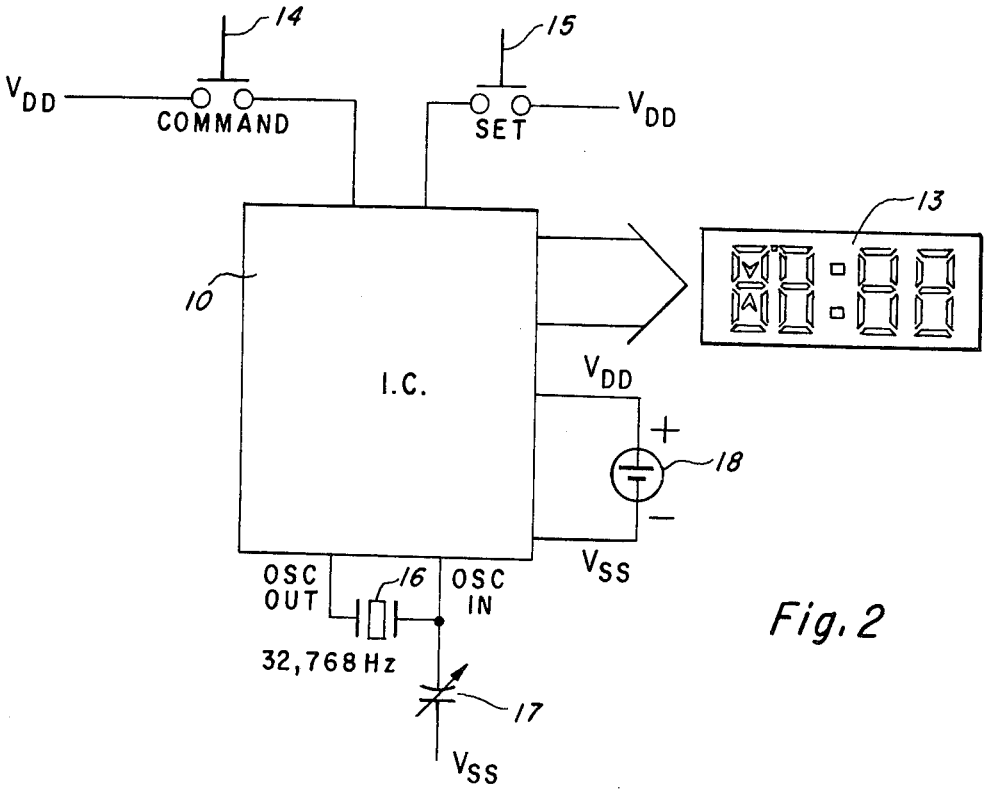
Fig. 2

ELECTRONIC TIMEPIECE

BACKGROUND OF THE INVENTION

This invention relates to electronic timepieces and more particularly to an electronic timepiece having a circuit for conserving battery power during the "shelf-life" of the electronic timepiece.

After an electronic timepiece either of the active (i.e., light-emitting diode) or passive (i.e., liquid crystal or electrochromic) display type is manufactured, one or two miniature batteries are inserted, and operation of the timepiece commences. The electronic timepiece is then tested and shipped for sale. During the "shelf-life" of the timepiece, which is the time period from which the electronic timepiece is manufactured and tested, shipped from the manufacturer to the distributor, shipped from the distributor to the retailer and sold by the retailer to the consumer, a significant portion of the total life of the battery may be expended.

It is therefore an object of the present invention to provide an improved electronic timepiece.

It is another object of the invention to provide an electronic timepiece which conserves battery power during the "shelf-life" of the electronic timepiece.

It is a further object of the invention to provide an electronic timepiece which is simply initialized to a predetermined state for testing and/or setting of the electronic timepiece.

BRIEF DESCRIPTION OF THE INVENTION

These and other objects are accomplished in accordance with the present invention in which an electronic timepiece is provided with a shutdown latch circuit. The latch circuit is initially set by insertion of a battery power source in the battery holder of the electronic timepiece. When the latch circuit is set, all other circuits in the timepiece, and particularly the display circuits, are turned off to conserve the batteries during the "shelf-life" of the electronic timepiece. When the command switch is first activated, the latch circuit is reset, and all of the other electronic circuits are turned on in a predetermined initialized condition.

For test purposes, a temporary power source may be connected to the timekeeping circuitry to set the latch circuit to force the timepiece into the predetermined initialized condition, and the command switch terminal activated. The timepiece is then tested from this "known" condition; if the timepiece operates properly, the temporary power source is replaced by a new battery which is sold with the timepiece. Replacing the battery sets the latch circuit in the shutdown condition again until the consumer purchases the timepiece and activates the command switch.

BRIEF DESCRIPTION OF THE DRAWINGS

Still further objects and advantages will become apparent from the detailed description and claims when read in conjunction with the accompanying drawings wherein:

FIG. 1 is a perspective view of an electronic timepiece incorporating the present invention;

FIG. 2 is a schematic diagram of the electronic watch of FIG. 1;

DETAILED DESCRIPTION OF THE PREFERRED EMBODIMENTS

Figure 3:
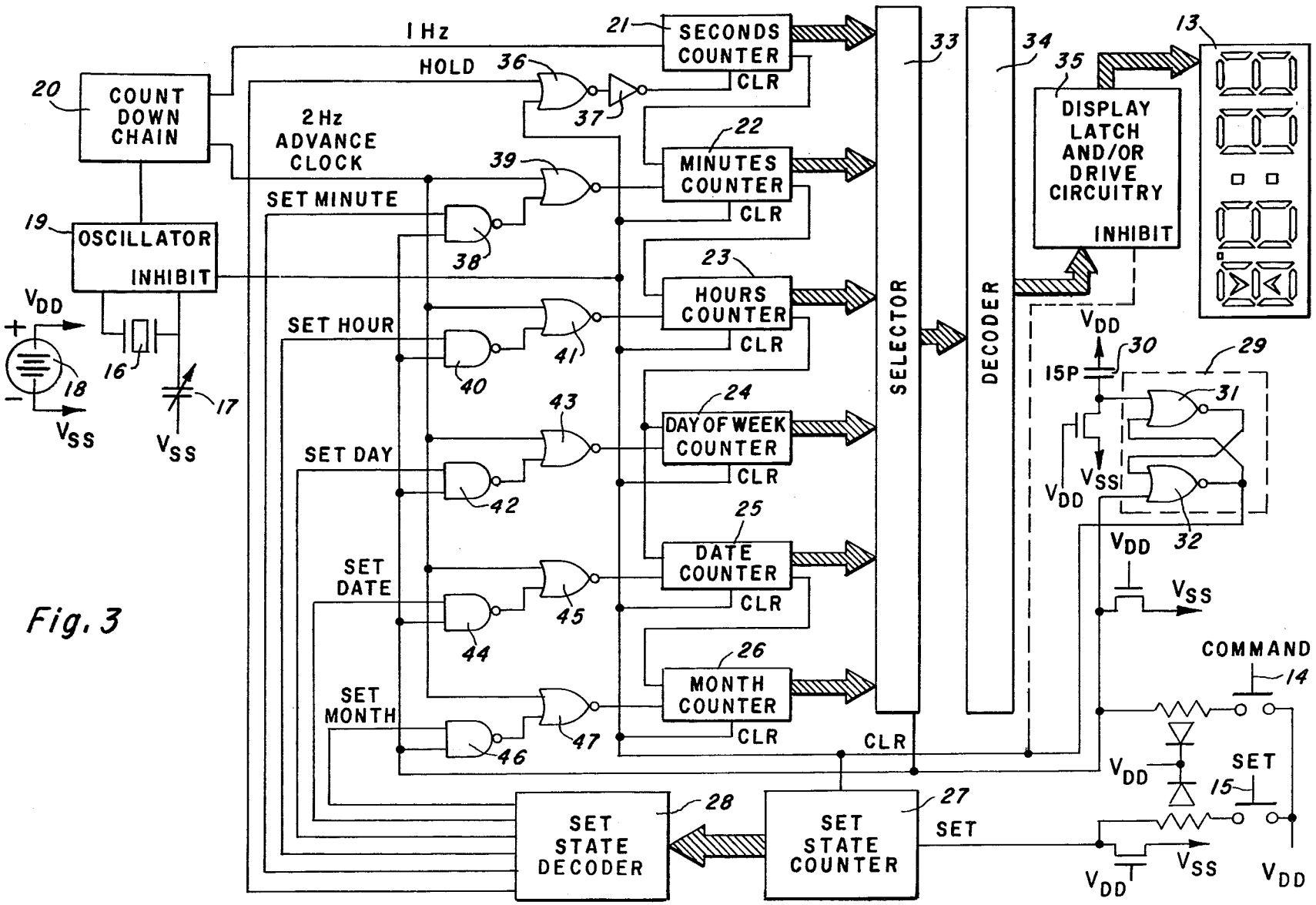
FIG. 3 is a more detailed circuit-logic diagram of the electronic watch of FIG. 1.

Referring then to the drawings, and particularly to FIG. 1, and electronic timepiece comprising the present invention is shown. The electronic timepiece includes a housing (i.e., watch case) 11 having a lens member 12 through which a display 13 is visible from without the housing. The electronic timepiece also includes a COMMAND switch 14 and a SET switch 15. Where the display is a passive display, such as a liquid crystal or electrochromic display, time or some other time-related function may be continuously displayed, and COMMAND switch 14 utilized to change the particular time-related information being displayed at any given time. For example, where hours and minutes are displayed continuously, the COMMAND switch 14 may be utilized to change the hours:minutes information being displayed to a display of seconds, day of the week, date and/or month. In an active display timepiece such as that which employs a light-emitting diode display, the display is normally off to conserve battery power; in this instance, the COMMAND switch 14 is utilized not only to select the particular time-related information to be displayed, but also to turn on the display. SET switch 15 is utilized to select the time-related function to be set (i.e., seconds, minutes, hours, day of the week, date, and/or month) and is utilized in conjunction with COMMAND switch 14 which, in conjunction with a clocking signal, skews the function selected by the SET switch 15.

The electronic components contained within the case 11 are illustrated in the schematic diagram of FIG. 2.

Referring then to FIG. 2, a semiconductor integrated circuit chip 10, which is generally of the CMOS type, is shown. Integrated circuit chip 10 includes all of the electronics necessary to provide the desired timekeeping functions, and operates from one or two miniature batteries 18 which, for an electronic wrist watch, are generally pill-type (i.e., hearing aid) batteries. Integrated circuit chip 10 includes the oscillator circuitry for generating a timing signal; however, a quartz crystal 16, which provides a reference frequency, and a variable capacitor 17, which provides for frequency adjustment, are provided external to the integrated circuit chip and connected in the oscillator circuit. Integrated circuit chip 10 is connected to a display 13 to display one or more time functions simultaneously or in a sequence selected either automatically or in response to activation of COMMAND switch 14.

COMMAND switch 14 and SET switch 15 selectively couple a voltage potential ($V_{DD}$) from battery source 18 to integrated circuit chip 10 to activate the respective function in the electronic circuitry contained in integrated circuit chip 10.

As previously mentioned, integrated circuit chip 10 is preferably CMOS (conventional MOS or bipolar circuitry may be utilized in other embodiments, if desired) and the display may be active (i.e., LED) or passive (LCD or electrochromic). For simplicity, a CMOS-LCD embodiment of the electronic timepiece will herein be discussed in detail; however, it should be understood that an electronic timepiece comprising any combination of the above is contemplated by the present invention. Further, although a particular electronic watch circuit is discussed, it is contemplated that any conventional watch circuitry could be utilized in combination with the disclosed novel shutdown latch circuit to provide an electronic timepiece in accordance with the present invention.

Referring then to FIG. 3, a schematic diagram of an electronic timepiece incorporating a novel shutdown circuit, in accordance with the present invention, is illustrated. A pill-sized battery 18 provides a voltage potential between negative terminal $V_{SS}$ and positive terminal $V_{DD}$. Battery 18 is utilized to provide power to all of the CMOS circuitry; however, only selected connections to the battery relating to the present invention are specifically designated in FIG. 3. Integrated circuit 10 includes oscillator 19 which operates in conjunction with external crystal 16 and variable capacitor 17 as indicated above. The output of the oscillator which, in the present embodiment, is nominally 32,768 Hz, is coupled to a countdown chain 20 of serially-coupled flip-flops which reduce the frequency to a 1-Hz time signal. Countdown chain circuit 20 is also taped at various intermediate points to provide other operating clock signals such as the indicated 2-Hz clock signal for advancing the various minutes, hours, day, date, month, etc, counters during the setting procedure. In normal operation, the 1-Hz signal is applied to seconds counter 21 which counts seconds and provides binary (e.g., binary coded decimal) output signal indicative thereof. As seconds counter 21 advances from 59 to 0 seconds, a signal is generated to minutes counter 22 which advances one count each 60 seconds or minute. Minutes counter 22 generates a coded output signal indicative of the minutes count, and generates a signal to hours counter 23 once each 60 minutes. Hours counter 23 advances one count each 60 minutes or hour in sets of 12 and/or 24 hours, and provides a coded output signal indicative of the hour count. Counter 23 also generates a signal once each 24 hours to counters 24 and 25 to advance the day of the week and date, respectively. Counter 24 counts 7 days of the week and provides a coded signal indicative thereof; counter 25 counts up to 31 days and provides a coded output signal indicative thereof. Date counter 25 may also be programmed to count sub-sets of 31 days, such as 28 and/or 29 days for February, and 30 days for April, June, September and November. Date counter 25 also generates a signal once each 31 days (or sub-set of 31, if so programmed) to month counter 26. Month counter 26 counts 12 months, and provides a coded output signal indicative thereof. The coded output signals generated by each of counter 21–26 are selectively transmitted by means of selector circuit 33 to decoder circuit 34. Selector circuit 33, which is coupled to and controlled by COMMAND switch 14, selects and multiplexes the digits to be displayed. For example, with an LCD continuous readout timepiece, hours and minutes may be continuously displayed on the four digits of display 13 with the coded outputs from hours counter 23 and minutes counter 22 being selected one digit at a time by selector circuit 33, decoded by decoder circuit 34 from the binary (e.g., binary coded decimal) coded format into display coded format which is stored and provided by latch/driver circuitry 35 to display 13. A single press of the button of COMMAND switch 14 may, for example, change selector circuit 33 to a second mode in which the output from seconds counter 21 is transferred to decoder 34, decoded into display format and displayed on two digits of display 13. Similarly, with two presses of the button of COMMAND switch 14, for example, the date and month coded outputs from counters 25 and 26, respectively, are selected by selector 33, decoded into display coded format by decoder 34 and displayed on the four digits of display 13. With three presses of the button of COMMAND switch 14, the day-of-the-week coded output signal is selected from counter 24 by selector 33, decoded into display coded format by decoder 34 and displayed by the special alphanumeric font characters provided as the left-hand digits of display 13. Such alphanumeric characters are the subject of design patent application Ser. No. 667,598, filed on Apr. 16, 1976, by Perry H. Pelley, entitled "FONT OF TEN SEGMENT CHARACTERS," and assigned to the assignee of the present invention.

The setting of the timepiece has been briefly described with respect to FIG. 1. The means by which the setting is accomplished is now discussed in detail with reference to FIG. 3. Set state counter 27 coupled to SET switch 15, advances one state each time SET switch 15 is activated, and generates a binary (or other) coded signal indicative of the contemporary count. In general, one count is provided for the setting of each function counter 22–26 (seconds counter is cleared during the setting mode but is not otherwise set) in addition to a neutral or off state in which the watch runs in the normal timekeeping mode; hence, for the illustrated embodiment, counter 27 is a six-state counter. Set state decoder 28, coupled to counter 27, generates, one at a time, set signals SET MINUTE, SET HOUR, SET DAY, SET DATE and SET MONTH. A HOLD signal is generated in the SET MINUTE mode as the minutes are being advanced; HOLD signal is applied via NOR gate 36 and NOT gate 37 to the clear CLR input of seconds counter 21 to retain seconds counter in the zero count condition during the entire setting mode (until set state counter 27 is advanced to the neutral or off condition). With set state counter in the non-neutral state, a selected one of the set control lines (SET MINUTE, SET HOUR, SET DAY, SET DATE, SET MONTH) is activated according to the count of set state counter 27. The set signals are coupled to counters 22–26 via respective NAND gate 38, 40, 42, 44 or 46. The other input of each of the NAND gates 38, 40, 42, 44 and 46 is coupled in common to COMMAND switch 14 so that the selected counter will be advanced only during activation of COMMAND switch 14. The set/command signal output from the selected NAND gate 38, 40, 42, 44 or 46 is applied via a respective NOR gate 39, 41, 43, 45 or 47 along with an ADVANCE clock signal (2 Hz, for example) to the respective counter 22–26 so that the selected counter is set at the advance clock signal rate.

In accordance with the present invention, the electronic timepiece includes latch circuit 29 which, in the present embodiment, is comprised of a pair of cross-coupled logic gates such as NOR gate 31 and 32. Latch circuit 29 is initially set by connection of battery power source 18 in the circuit which supplies voltage levels $V_{DD}$ and $V_{SS}$ to the circuitry of the electronic timepiece at the points indicated. When this occurs, capacitor 30 (which may be on the order of, for example, 15 pf) is charged up and causes latch 29 to toggle to a SET condition which inhibits oscillator 19 by providing a short across the oscillator input thereby preventing dynamic power consumption by the rest of the electronic circuitry. In the SET condition, latch 29 also inhibits the drive circuitry, as will later be discussed in detail, to prevent power consumption by display 13, and generates a CLR signal to clear counters 22–27 (and any other of the circuitry which it is desired to initialize to a predetermined condition). In one embodiment, the CLR signal clears all of the flip-flops of counters 22–26 so that they are set to a zero count and so that counter 27 is set to a state in which a first function (one of the counters 22–26) is ready to be set to the present time, day, date, etc. The electronic timepiece remains in this "shutdown" condition during its entire "shelf-life". When the COMMAND switch 14 is next activated (by a consumer, for example), latch circuit 29 is toggled to a RESET condition which uninhibits oscillator circuit 19 and display drive circuitry 35 to power up the electronic circuitry and display 13 and the timekeeping (or set) function commences from the predetermined initialized condition.

Although in the present embodiment, latch circuit 29 is coupled to and controlled by COMMAND switch 14, in another embodiment, latch circuit 29 may likewise be coupled to and controlled by SET switch 15, both switches 14 and 15 being essentially electrically equivalent, as shown.

In an electronic timepiece embodying the present invention which utilizes an active display, such as an LED-type display with the display being activated by COMMAND switch 14, it is unnecessary to provide means for inhibiting the display since the display is already normally inactive. In an embodiment which, on the otherhand, utilizes a passive display, such as a liquid crystal which is normally in the display mode, means must be provided in the display latch/drive circuitry 35 which is responsive to the system CLR clear signal to inhibit the display. A further complexity arises since the liquid crystal display is energized by out-of-phase AC signals. In accordance with an aspect of the present invention, digit latch/drive circuitry 35, which includes means for inhibiting such liquid crystal display, is provided, as illustrated in detail in FIG. 4.

Figure 4:
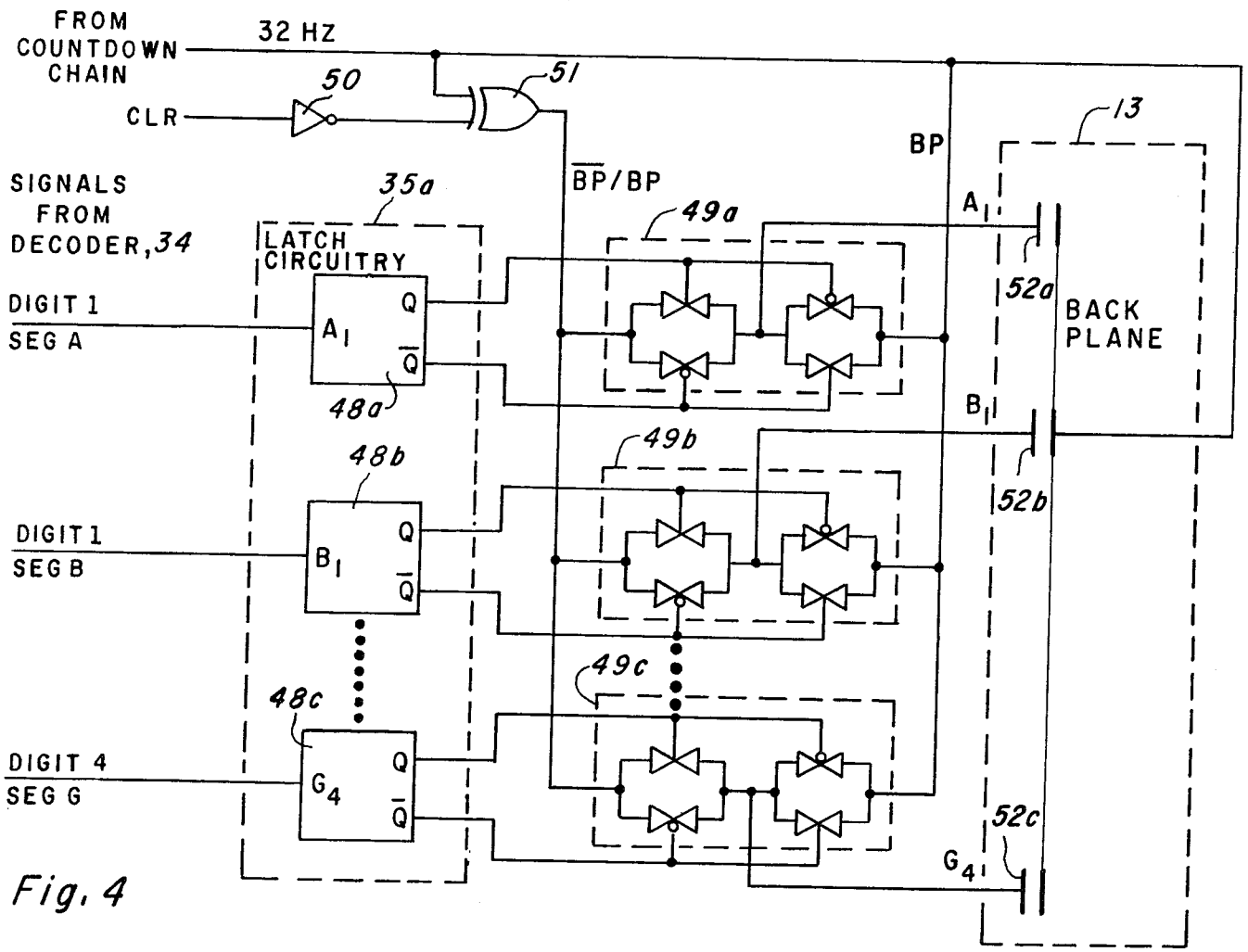
FIG. 4 is a circuit diagram of the display latch/drive circuitry.

Referring then to FIG. 4, the decoded segments $A_1$, $B_1 \ldots G_4$ are transmitted for one digit at a time from decoder 34 to a respective set of the latches 48*a*, 48*b* . . . 48*c*, which correspond to the particular digit, one latch is provided for each segment of each digit, $A_1$, $B_1 \ldots G_4$ ( a total of 31 for the four digits of the illustrated embodiment). A 32-kHz AC clocking signal BP is utilized to energize the backplane of the liquid crystal display. A segment is energized if a signal of opposite polarity $\overline{BP}$ is applied to the corresponding segment electrode 52*a*, 52*b* . . . 52*c*. Thus, latches 48*a*, 48*b* . . . 48*c* are connected in controlling relationship to respective transmission gates 49*a*, 49*b* . . . 49*c*, which selectively transmit either a BP or a $\overline{BP}$ to the electrodes 52*a*, 52*b* . . . 52*c* in accordance with the state of the respective latch 48*a*, 48*b* . . . 48*c*. Transmission gates 49*a*, 49*b* . . . 49*c* are each comprised of two pairs of complementary transistors (p-channel and n-channel) wherein both of the transistors of only one of the pairs conduct. In order to inhibit the display, it is therefore necessary for an in-phase signal BP to be applied to all of the segment electrodes 52*a*, 52*b* . . . 52*c* to turn off the display. This is accomplished by EXCLUSIVE OR gate 51 which has one input connected to the BP signal and the other input connected to the system clear signal provided by shutdown latch circuit 29 via NOT gate 50. Thus, whenever shutdown latch circuit 29 is SET and the system clear signal is present (logical 1), the output of NOT gate 50 is a logical zero and the output of EXCLUSIVE OR gate 51 is BP, so that no matter what state latches 48*a*, 48*b* . . . 48*c* are in, display 13 is maintained in an off condition. When shutdown latch circuit 29 is RESET, the output of NOT gate 50 is a logical 1 and the output of EXCLUSIVE OR gate 51 is $\overline{BP}$, thus enabling latches 48*a*, 48*b* . . . 48*c* to control the states of the display segments by means of transmission gates 49*a*, 49*b* . . . 49*c* which can then transmit either BP or $\overline{BP}$ to the display segments.

In the above CMOS embodiment, wherein power consumption is dependent upon the dynamic flow of data through the system, current consumption is prevented by inhibiting oscillator 19 so that data does not dynamically flow through the system. In a non-dynamic embodiment such as in an $I^2L$ circuit (such as described in U.S. Pat. No. 3,986,199), a latch circuit 29 may be coupled to inhibit the current source to prevent current from flowing (e.g., by means of the current injectors) to the electronic circuitry comprising the electronic timekeeping system.

The novel features of the invention have now been described in detail with respect to preferred embodiments thereof. Since it is obvious that many changes and modifications can be made in the above details without departing from the nature and spirit of the invention, it is understood that the invention is not to be limited to said details except as set forth in the appended claims.

What is claimed is:

1. An electronic timepiece comprising:

a. electronic timekeeping circuitry responsive to a reference frequency signal for generating electrical signals indicative of timekeeping functions;

b. display means coupled to said timekeeping circuitry and responsive to said electrical signals for displaying said timekeeping functions;

c. switch means coupled to said electronic timekeeping circuitry for controlling a function thereof;

d. battery receiving means for receiving battery means to power said electronic timekeeping circuitry; and e. shutdown latch circuit means coupled to said battery receiving means and to said switch means, said latch circuit means being responsive to a voltage applied from said battery receiving means for toggling to a first state in which power consumption by preselected circuits of said electronic timekeeping circuitry is inhibited and responsive to said switch means for toggling to a second state in which power consumption by said preselected circuits is enabled upon the first activation of said switch means after said latch circuit means is set in said first state, said latch circuit means remaining in said second state so long as a voltage is present from said battery receiving means, wherein f. battery power during the "shelf-life" of the electronic timepiece is conservable with said latch circuit in said first state.

2. An electronic timepiece according to claim 1, wherein said electronic display means is an active display, and wherein said switch means is coupled to said electronic timekeeping circuitry for activating said display means.

3. An electronic timepiece according to claim 1, wherein said display means is a passive display means and said switch means is coupled to said electronic timekeeping circuitry for changing the timekeeping function being displayed by said display means.

4. An electronic timepiece according to claim 1, wherein said switch means is coupled to said electronic timekeeping circuitry for controlling the setting of the timekeeping functions thereof.

5. An electronic timepiece according to claim 1, wherein said latch circuit means is comprised of a pair of cross-coupled logic gates.

6. An electronic timepiece according to claim 1, wherein said latch circuit means includes capacitor means responsive to the presence of a battery power source in said battery receiving means to set said latch in said first state.

7. An electronic timepiece according to claim 1 including a watch housing having a lens member, said electronic timekeeping circuitry and display and latch circuit means contained within said housing with said display being visible exterior to said housing through said lens member and an activator member extending to the exterior to said housing, said activator member being coupled to said switch means for activating said switch means to control said function.

8. An electronic timepiece according to claim 1, wherein selected ones of said preselected circuits of said electronic timekeeping circuitry include means for presetting the state thereof, and wherein said latch circuit means is coupled to each of said presetting means for presetting said selected circuits to a predetermined initialized state when said latch circuit means is set in said first state.

9. An electronic timepiece according to claim 8, wherein said electronic timekeeping circuitry includes cascaded counter circuits for counting pulses of said reference frequency signal and generating the electrical signals indicative of said timekeeping functions, and wherein, in said predetermined intialized state, all of the counter circuits of said electronic timekeeping circuitry are set to a state indicative of a zero count.

10. An electronic timepiece according to claim 1, wherein said switch means is a COMMAND switch for controlling the timekeeping function displayed by said display means, and wherein said electronic timepiece includes second switch means for controlling the setting of a plurality of said timekeeping functions.

11. An electronic timepiece according to claim 10, wherein said electronic timekeeping circuitry includes set counter means responsive to said SET switch means for selecting a timekeeping function to be set, and wherein said COMMAND switch is coupled to said timekeeping circuitry for skewing the selected timekeeping function.

12. An electronic timepiece according to claim 11, wherein said set counter means includes initializing means for presetting the state thereof, and wherein said shutdown latch circuit means is coupled to said initializing means for presetting said set counter means to a predetermined initialized state when said shutdown latch circuit means is set in said first state.

13. An electronic timepiece according to claim 1, wherein said electronic timekeeping circuitry and said shutdown latch circuit means are integrated on a single semiconductor substrate.

14. An electronic timepiece according to claim 12, wherein said electronic timekeeping circuitry and said shutdown latch circuit are comprised of CMOS circuitry.

15. An electronic timepiece according to claim 1, wherein said preselected circuits of said electronic timekeeping circuitry consume power upon the dynamic flow of data therein, and wherein said electronic timepiece includes an oscillator circuit coupled to said timekeeping circuitry for generating said reference frequency signal, and means coupled to said shutdown latch circuit means for inhibiting said oscillator circuit to thereby prevent dynamic data flow through said preselected circuits.

16. An electronic timepiece according to claim 15, wherein said electronic timekeeping circuitry is comprised of dynamic CMOS circuits.

17. An electronic timepiece according to claim 1, wherein said electronic timekeeping circuitry is comprised of $I^2L$ circuits, and wherein said electronic timepiece includes current regulator means for providing injection current to said electronic timekeeping circuitry, and means coupled to said shutdown latch means for inhibiting said current regulator means to thereby prevent current flow to said preselected circuits.

18. An electronic timepiece according to claim 1 including inhibitable circuit means coupling said timekeeping circuitry to said display means, said inhibitable circuit means being coupled to said shutdown latch circuit means for disabling said display means when said shutdown latch circuit means is set in said first state.

19. An electronic timepiece according to claim 1, wherein said display means is a liquid crystal type display having a common backplane electrode and a plurality of segment electrodes arranged in a pattern by which said timekeeping functions are displayable, and wherein said electronic timepiece includes means coupling said electronic timekeeping circuitry to said backplane electrode for providing an AC backplane signal of predetermined frequency to said backplane electrode, and circuit means coupling said timekeeping circuitry to said segment electrodes, said circuit means being responsive to said electrical signals, for selectively providing segment-energizing signals which are in-phase and out-of-phase with said backplane signal to display said timekeeping functions by said display means.

20. An electronic timepiece according to claim 19, wherein said circuit means includes a plurality of latch circuits for storing electrical signals indicative of the timekeeping functions displayed by said liquid crystal display means, a plurality of transmission gate circuits respectively coupled to said latch circuits, said transmission gate circuits being controlled by said latch circuits for selectively applying the in-phase and out-of-phase segment-energizing signals to respective segment electrodes, and logic gate means coupled to said shutdown latch circuit means for selectively transferring said in-phase and out-of-phase segment-energizing signals to said transmission gates wherein only said in-phase signal is transferred to said transmission gates when said latch circuit means is set in said first state to disable said display means, and wherein both said in-phase and out-of-phase signals are transferred to said transmission gates when said latch circuit means is set in said second state whereby said display means is responsive to said electrical signals stored in said latch means.

21. An electronic timepiece according to claim 20, wherein said logic gate means is comprised of an EXCLUSIVE OR gate.

22. An electronic timepiece comprising;

a. inhibitable oscillator means for generating a reference frequency;

b. CMOS electronic timekeeping circuitry coupled to said oscillator means and responsive to said reference frequency signal for generating electrical signals indicative of timekeeping functions;

c. display means coupled to said timekeeping circuitry and responsive to said electrical signals for displaying said timekeeping functions;

d. switch means coupled to said electronic timekeeping circuitry for controlling a function thereof;

e. battery receiving means for receiving battery means to power said electronic timekeeping circuitry; and f. shutdown latch circuit means coupled to said battery receiving means and to said switch means, said latch circuit means being responsive to a voltage applied from said battery receiving means for toggling to a first state in which said oscillator means is inhibited and responsive to said switch means for toggling to a second state in which said oscillator circuit is enabled, said latch circuit means thereafter remaining in said second state so long as said voltage is present from said battery receiving means, wherein battery power is conservable during the "shelf-life" of the electronic timepiece with said shutdown latch circuit in said first state.

23. An electronic timepiece according to claim 22, wherein said display means is a liquid crystal type display having a common backplane electrode and a plurality of segment electrodes arranged in a pattern by which said timekeeping functions are displayable, and wherein said electronic timepiece includes means coupling said electronic timekeeping circuitry to said backplane electrode for providing an AC backplane signal of predetermined frequency to said backplane electrode, and circuit means coupling said timekeeping circuitry to said segment electrodes, said circuit means being responsive to said electrical signals, for selectively providing segment-energizing signals which are in-phase and out-of-phase with said backplane signal to display said timekeeping functions by said display means.

24. An electronic timepiece according to claim 20, wherein said circuit means includes a plurality of latch circuits for storing electrical signals indicative of the timekeeping functions displayed by said liquid crystal display means, a plurality of transmission gate circuits respectively coupled to said latch circuits, said transmission gate circuits being controlled by said latch circuits for selectively applying the in-phase and out-of-phase segment-energizing signals to respective segment electrodes, and logic gate means coupled to said shutdown latch circuit means for selectively transferring said in-phase and out-of-phase segment-energizing signals to said transmission gates wherein only said in-phase signal is transferred to said transmission gates when said latch circuit means is set in said first state to disable said display means, and wherein both said in-phase and out-of-phase signals are transferred to said transmission gates when said latch circuit means is set in said second state whereby said display means is responsive to said electrical signals stored in said latch means.

* * * * *